US009963895B2

(12) United States Patent
Bernardi et al.

(10) Patent No.: US 9,963,895 B2
(45) Date of Patent: May 8, 2018

(54) CONCENTRIC HELICAL COIL KEY SEPARATOR DEVICE AND ATTACHMENT THEREFOR

(71) Applicant: United States ThermoAmp Inc., Latrobe, PA (US)

(72) Inventors: William P. Bernardi, Ligonier Township, PA (US); Mark MacLean-Blevins, Westminster, MD (US)

(73) Assignee: United States ThermoAmp Inc., Latrobe, PA (US)

( * ) Notice: Subject to any disclaimer, the term of this patent is extended or adjusted under 35 U.S.C. 154(b) by 887 days.

(21) Appl. No.: 14/263,593

(22) Filed: Apr. 28, 2014

(65) Prior Publication Data

US 2014/0318738 A1 Oct. 30, 2014

Related U.S. Application Data

(60) Provisional application No. 61/817,057, filed on Apr. 29, 2013, provisional application No. 61/913,579, filed on Dec. 9, 2013.

(51) Int. Cl.

| | |
|---|---|
| ***F16M 13/00*** | (2006.01) |
| ***E04H 4/12*** | (2006.01) |
| ***F28F 9/013*** | (2006.01) |
| ***F28D 7/02*** | (2006.01) |

(52) U.S. Cl.

CPC ..... *E04H 4/129* (2013.01); *F28D 7/024* (2013.01); *F28F 9/013* (2013.01); *F28F 2240/00* (2013.01); *F28F 2275/085* (2013.01)

(58) Field of Classification Search

CPC ... F16L 3/24; F16L 55/035; F16L 3/13; F16L 3/237; F16L 3/04; F16L 3/223; F16L 3/12; F16L 3/2235; F16L 3/127; F16L 3/1075; F16L 3/22; F16L 3/137; F16L 3/233; F16L 3/08; F16L 3/133; F16L 3/23

USPC ..... 248/68.1, 74.1, 74.2

See application file for complete search history.

(56) References Cited

U.S. PATENT DOCUMENTS

| | | | | |
|---|---|---|---|---|
| 5,669,590 | A * | 9/1997 | Przewodek | F16L 3/221 248/68.1 |
| 6,435,565 | B2 * | 8/2002 | Potts | F16L 3/237 24/16 R |
| 7,467,490 | B2 * | 12/2008 | Mossberg | F41A 21/08 42/77 |
| 7,721,360 | B2 | 5/2010 | Bernardi et al. | |

(Continued)

*Primary Examiner* — Steven M Marsh

(74) *Attorney, Agent, or Firm* — The Webb Law Firm

(57) ABSTRACT

A separator device for separating coils of a heat exchanger assembly has a top surface opposite a bottom surface, and an inner portion opposite an outer portion. The inner portion and the outer portion extend between the top surface and the bottom surface. The separator device further includes a pair of sides extending between the inner portion and the outer portion, each of the sides defining a concave curve having an apex. A lug is provided to connect the apex of each concave curve. At least one ramp is defined on the top surface and/or the bottom surface, extending from the inner portion toward the lug. The lug is arcuately shaped to project away from the top surface and the bottom surface and is shaped to correspond to a gap between adjacent coils of the heat exchanger assembly.

20 Claims, 10 Drawing Sheets

(56) References Cited

U.S. PATENT DOCUMENTS

| | | | | |
|---|---|---|---|---|
| 7,886,406 | B2 * | 2/2011 | Chang | E05D 5/08 16/252 |
| 8,083,432 | B2 * | 12/2011 | Limpert | F16L 3/16 24/336 |
| 8,093,501 | B2 * | 1/2012 | Stansberry, Jr. | H02G 7/05 174/146 |
| 9,534,708 | B2 * | 1/2017 | Cripps, II | F16L 3/222 |

* cited by examiner

PRIOR ART

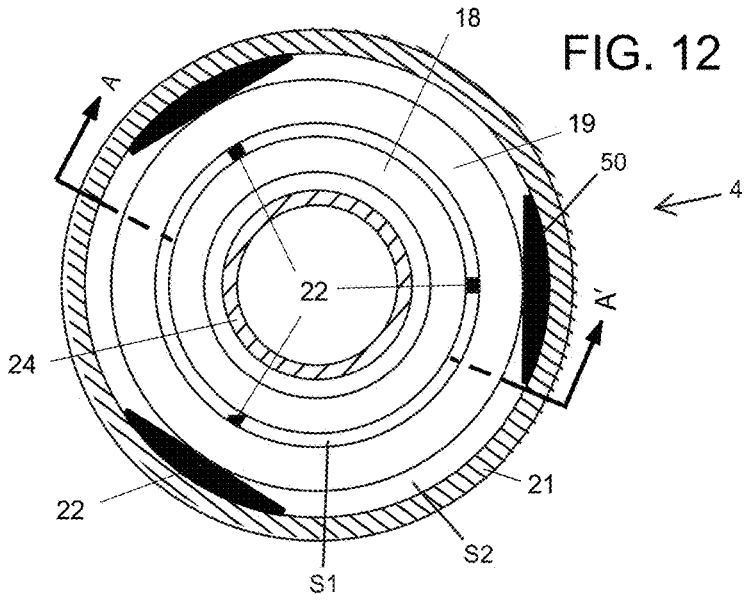
FIG. 12
FIG. 13
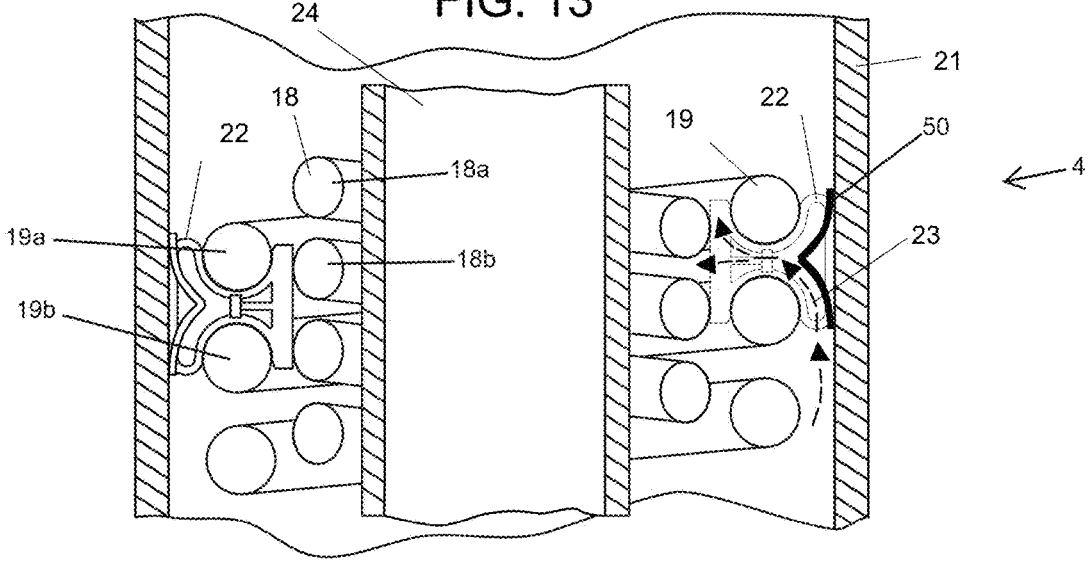

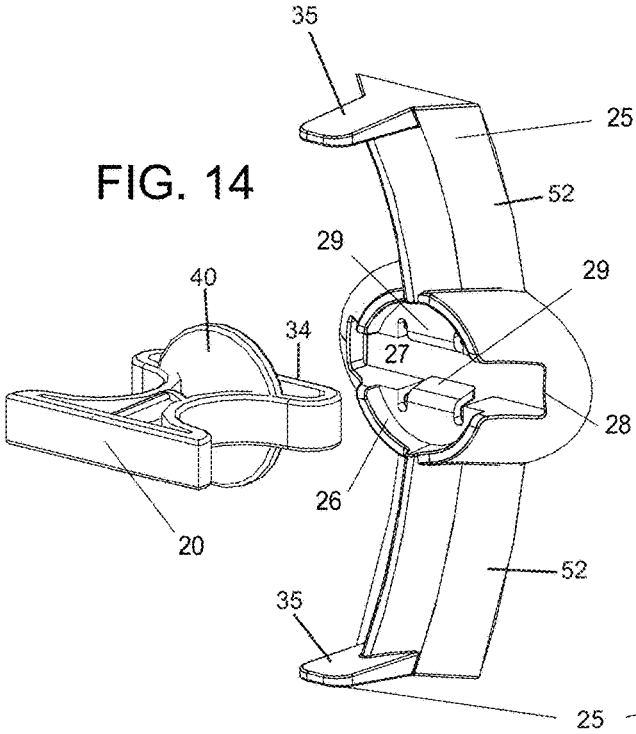
FIG. 14
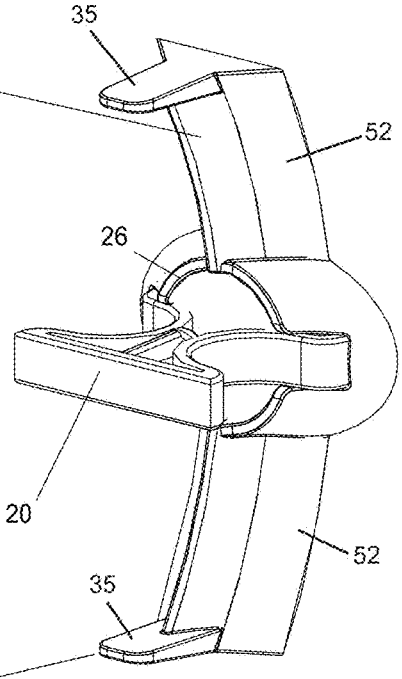
FIG. 15
FIG. 16
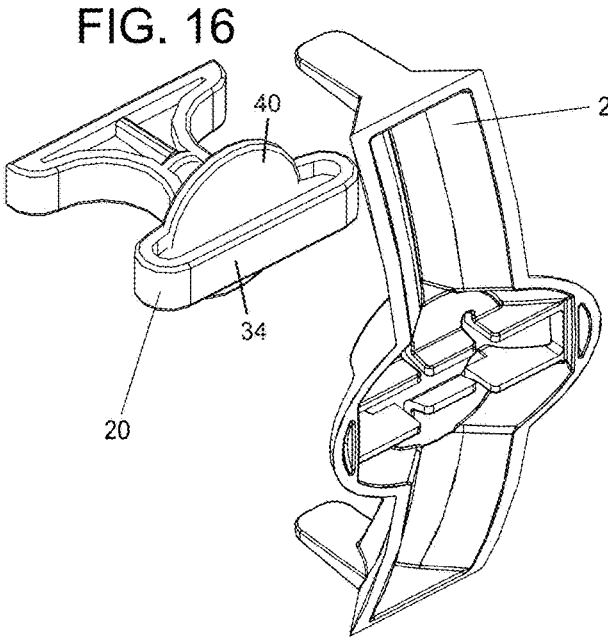
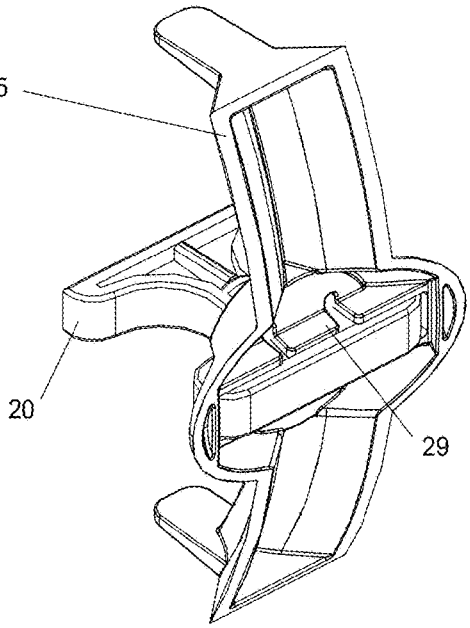
FIG. 17

CONCENTRIC HELICAL COIL KEY SEPARATOR DEVICE AND ATTACHMENT THEREFOR

CROSS-REFERENCE TO RELATED APPLICATIONS

The present application claims priority to U.S. Provisional Patent Application No. 61/817,057, entitled "Coil Key Separator Device for Concentric Helical Coil" and filed on Apr. 29, 2013, and to U.S. Provisional Patent Application No. 61/913,579, entitled "Attachment for a Coil Key Separator Device for a Helical Heat Exchange Assembly" and filed on Dec. 9, 2013, the disclosures of which are incorporated herein by reference in their entirety.

BACKGROUND OF THE INVENTION

Field of the Invention

The present invention relates generally to heat exchanger systems and arrangements, such as a helical heat exchanger tube assembly, and in particular to an improved coil key separating device and attachment therefor for use in a helical heat exchanger tube assembly having inner and outer coils.

Description of the Related Art

Swimming and relaxing in a pool or spa are popular pastimes. Swimming pools, both public and private, offer relief from the heat while also offering an opportunity for social gatherings and fun. Several types of swimming pools and spas exist, including in-ground pools, above-ground pools, wading pools for small children, spas, hot tubs, and whirlpools. Swimming pools and spas can be located outdoors, as in the back yard of a house or at a public area, or indoors, as in a hotel pool, for example. Further, swimming pools can be found in various sizes, ranging from a small, above-ground pool that is only a few feet in depth, to a large, Olympic-sized pool, designed for competitive swimming and/or diving. Similarly, spas, hot tubs, and whirlpools can be found in various sizes.

Many pools, especially indoor pools, are typically heated for the comfort of users. Spas, hot tubs, and whirlpools are also heated for the comfort of users, as well as for therapeutic purposes of users. Since most indoor pools, including hotel pools and community pools, remain open to users year-round, and since most spas also remain open year-round, it is necessary for the heat exchanger that heats the pool or spa water to be able to work reliably with little maintenance or repairs.

Due to the necessity of swimming pool pumps to move or turn over the entire volume of pool water through the pool filter several times a day, any full-flow heat exchanger must handle a high flow rate and, thus, high velocity of the water flowing through the heat exchanger. This high velocity poses several problems, as the high velocity could cause vibration of the heat exchanger coil tubes that heat the water. The coil tubes have a natural spring resonant frequency and are prone to vibration. The vibration could be in the hundreds or even thousands of cycles per second. Over time, the vibrations may rub the material in the sidewall of the tube and create a hole, thereby allowing the gas contained therein to escape and water to enter the tube.

Due to the corrosive chlorine and pool sanitation chemicals used to treat swimming pools, including inorganic chlorinating agents, such as calcium hypochlorite, lithium hypochlorite, sodium hypochlorite, and organic chlorinating agents, such as trichloroisocyanuric acid, potassium dichloroisocyanurate, or sodium dichlorocyanurate in anhydrous or dihydrate forms, the tube material may include an alloy, such as titanium or a high alloy stainless steel, that can withstand these chemicals without fouling or corrosion, and to ensure continued service over time. The above alloys are typically costly materials. In order to maximize heat transfer and minimize expense, thin wall tubing is commonly used in swimming pool and spa heat exchangers. Alloys such as these develop a hard film oxide coating, which helps to prevent the corrosion caused by chlorine and other pool sanitation chemicals. This coating is abrasive, which requires additional precautions to prevent tube damage caused by the wall tubing rubbing together.

Because the heat exchanger coil typically has an inner coil assembly arranged concentrically within an outer coil assembly, it is desirable to centrally align the inner coil assembly relative to the outer coil assembly for optimum heat transfer and uniform fluid velocity. Furthermore, it is desirable to maintain an equal spacing between the individual coils of the inner and outer coil assemblies. Various methods and devices for centering the coil assemblies and maintaining a separation between the individual coils have been developed. For example, silicone rubber can be injected between the coils at various intervals. Additionally, rubber or plastic bumpers may be inserted between the coils. In other embodiments, long strips of material are inserted axially between the inner and outer coil assemblies during their formation or after they are formed.

Within the prior art, U.S. Pat. No. 7,721,360 to Bernardi et al., incorporated herein in its entirety, describes a dog bone-shaped coil key separator device for use in a swimming pool heat exchanger. With reference to FIGS. 4-5 of the present application, the separator device 17 has an inner portion, a curved middle portion, and an outer portion. The outer portion has rounded outer edges to facilitate gripping and twisting the separator device 17 during installation between the coils of an outer coil 19 of the heat exchanger coil assembly. The inner portion of the separator device 17 is substantially flat so that it rests against the side of an inner coil 18 of the heat exchanger coil assembly. The curved middle portion rests between an upper and lower section of the outer coil 19. The separator device 17 is inserted between adjacent portions or sections of the outer coil 19, such that the outer portion and the inner portion of the separator device 17 are positioned longitudinally with respect to the adjacent sections of the outer coil during insertion. Once the inner portion comes into contact with the inner coil 18, the outer portion of the separator device 17 is twisted clockwise or counterclockwise into a locked position, such that the curved middle portion of the separator device 17 rests between the adjacent sections of the outer coil 19. In the locked position, the separator device 17 substantially prevents the adjacent coils of the outer coil 19 from vibrating against each other, the adjacent coils of the inner coil 18 from vibrating against each other, and the outer coil 19 from vibrating against the inner coil 18.

However, existing methods require substantial care and time to assemble, and, in some cases, must be subject to or include baking or curing time for setting up the material before the heat exchanger coils can be used. Further, many of these methods are also costly to manufacture and may not promote water flow between the coils.

SUMMARY OF THE INVENTION

Generally, provided are a concentric helical coil key separator device and attachment therefor that overcome or address certain drawbacks and deficiencies of existing heat exchanger systems and arrangements. Preferably, provided are a concentric helical coil key separator device and attachment therefor that are useful in connection with both new and existing heat exchanger systems and arrangements.

In various preferred and non-limiting embodiments, provided are different configurations of a coil key separator device having enhanced functionality, fluid flow tuning, fluid flow directional routing, fluid flow boundary manipulation, and/or enhanced manufacturing. In one preferred and non-limiting embodiment, a separator device for separating coils of a heat exchanger assembly may have a top surface opposite a bottom surface, and an inner portion opposite an outer portion. The inner portion and the outer portion may extend between the top surface and the bottom surface. The separator device may further include a pair of sides extending between the inner portion and the outer portion, each of the sides defining a concave curve having an apex. A lug may be provided to connect the apex of each concave curve. At least one, and preferably a pair of ramps may be defined on the top surface and the bottom surface, respectively, extending from the inner portion toward the lug.

In another preferred and non-limiting embodiment, the lug may be arcuately shaped to project away from the top surface and the bottom surface and may be shaped to correspond to a gap between adjacent coils of the heat exchanger assembly. Each of the ramps may be inclined relative to the top surface and the bottom surface from the inner portion to the lug. The pair of ramps may be configured to gradually increase a gap between adjacent coils of the heat exchanger assembly as the separator device is inserted between the coils. The separator device may further include a disc extending from the top surface and the bottom surface at the outer portion. The disc may be larger than a gap between adjacent coils of the heat exchanger assembly to prevent over insertion of the separator device into the gap.

In accordance with another preferred and non-limiting embodiment, a separator device for separating coils of a heat exchanger assembly may include a top surface opposite a bottom surface, and an inner portion opposite an outer portion. The inner portion and the outer portion may extend between the top surface and the bottom surface. The separator device may further include a pair of sides extending between the inner portion and the outer portion, each of the sides defining a concave curve having an apex. A wing may extend from the outer portion in a direction of the sides, wherein the wing has at least one, and preferably a pair of arcuate surfaces shaped to deflect fluid flow into a gap defined between adjacent coils of the heat exchanger assembly.

In another preferred and non-limiting embodiment, the wing may be larger than a gap between adjacent coils of the heat exchanger assembly to prevent over insertion of the separator device into the gap. A lug may be provided to connect the apex of each concave curve. At least one, and preferably a pair of ramps may be defined on the top surface and the bottom surface, respectively, extending from the inner portion toward the lug. The lug may be arcuately shaped to project away from the top surface and the bottom surface and may be shaped to correspond to a gap between adjacent coils of the heat exchanger assembly. Each of the ramps may be inclined relative to the top surface and the bottom surface from the inner portion to the lug. The pair of ramps may be configured to gradually increase a gap between adjacent coils of the heat exchanger assembly as the separator device is inserted between the coils.

In accordance with another preferred and non-limiting embodiment, a separator device assembly for separating coils of a heat exchanger assembly may include a separator device having a top surface opposite a bottom surface, and an inner portion opposite an outer portion. The inner portion and the outer portion may extend between the top surface and the bottom surface. The separator device may further include a pair of sides extending between the inner portion and the outer portion, each of the sides defining a concave curve having an apex. A lug may be provided to connect the apex of each concave curve. At least one, and preferably a pair of ramps may be defined on the top surface and the bottom surface, respectively, extending from the inner portion toward the lug. A disc may extend from the top surface and the bottom surface at the outer portion. The assembly may further include an attachment removably connectable to the separator device. The attachment may include a central receptacle configured for receiving the disc of the separator device, an opening in the central receptacle configured for receiving the outer portion of the separator device, and at least one, and preferably a pair of extensions extending radially outward from the central receptacle.

In a further preferred and non-limiting embodiment, the attachment may further include at least one, and preferably a pair of locking tabs configured for locking the outer portion to the central receptacle. The locking tabs may be deflectable such that the locking tabs are pushed outward by the outer portion as the outer portion enters the opening and such that the locking tabs snap over the outer portion to lock the outer portion to the central receptacle. Each of the extensions of the attachment may be curved to correspond to a curvature of a coil of the heat exchanger assembly. Additionally, each of the extensions may have at least one, and preferably a pair of arcuate surfaces configured for deflecting fluid flow into a gap defined between adjacent coils of the heat exchanger assembly.

These and other features and characteristics of the present invention, as well as the methods of operation and functions of the related elements of structures and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and the claims, the singular form of "a", "an", and "the" include plural referents unless the context clearly dictates otherwise.

BRIEF DESCRIPTION OF THE DRAWINGS

For a fuller understanding of the nature of the present invention, reference should be had to the following detailed description taken in connection with the accompanying drawings in which:

FIG. 12 is a top view of the coil key shown in FIG. 10 in use with the heat exchanger coil assembly;

FIG. 13 is a cross-sectional view taken along line A-A' in FIG. 12;

FIG. 14 is a rear perspective view of a coil key and an attachment therefor in accordance with one embodiment of the present invention, showing the coil key and the attachment in a disassembled state;

FIG. 15 is a rear perspective view of the coil key and the attachment therefor illustrated in FIG. 14, showing the coil key and the attachment in an assembled state;

FIG. 16 is a front perspective view of the coil key and the attachment therefor illustrated in FIG. 14, showing the coil key and the attachment in the disassembled state;

FIG. 17 is a front perspective view of the coil key and the attachment therefor illustrated in FIG. 14, showing the coil key and the attachment in the assembled state;

DETAILED DESCRIPTION OF THE PREFERRED EMBODIMENTS

Figure 1:
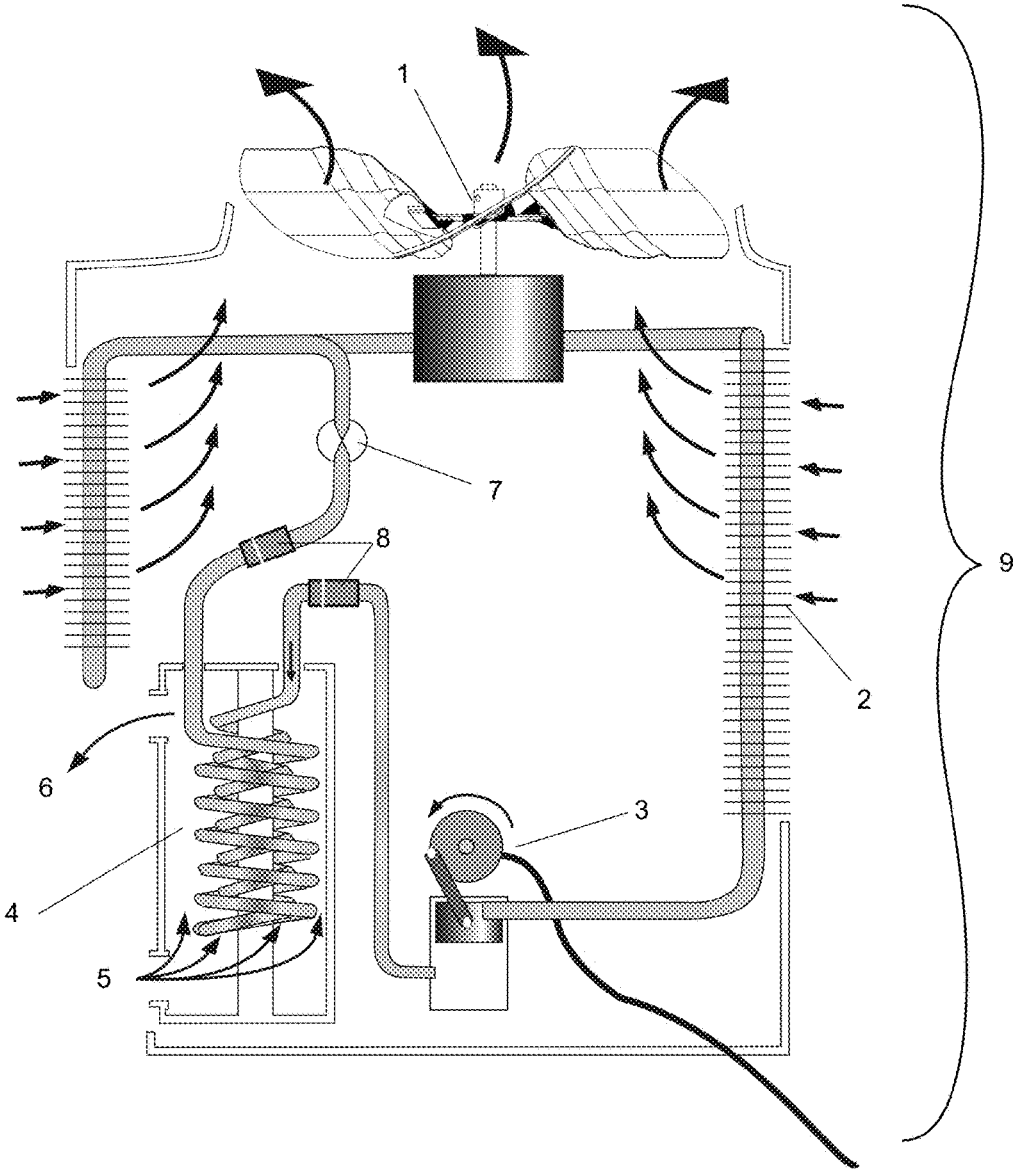
FIG. 1 is a schematic of a heat pump system having a water side heat exchanger.

The illustrations generally show preferred and non-limiting embodiments of the systems and methods of the present disclosure. While the descriptions present various embodiments of the devices, it should not be interpreted in any way as limiting the disclosure. Furthermore, modifications, concepts, and applications of the disclosure's embodiments are to be interpreted by those skilled in the art as being encompassed, but not limited to, the illustrations and descriptions herein.

Further, for purposes of the description hereinafter, the terms "end", "upper", "lower", "right", "left", "vertical", "horizontal", "top", "bottom", "lateral", "longitudinal", and derivatives thereof shall relate to the disclosure as it is oriented in the drawing figures. The term "proximal" refers to the direction toward the center or central region of the device. The term "distal" refers to the outward direction extending away from the central region of the device. However, it is to be understood that the disclosure may assume various alternative variations and step sequences, except where expressly specified to the contrary. It is also to be understood that the specific devices and processes illustrated in the attached drawings, and described in the following specification, are simply exemplary embodiments of the disclosure. Hence, specific dimensions and other physical characteristics related to the embodiments disclosed herein are not to be considered as limiting. For the purpose of facilitating understanding of the disclosure, the accompanying drawings and description illustrate preferred embodiments thereof, from which the disclosure, various embodiments of its structures, construction and method of operation, and many advantages may be understood and appreciated.

With reference to FIG. 1, a heat pump 9 includes an air-moving device 1, such as a fan, and an evaporator 2 adapted for extracting heat from the air moved by the air-moving device 1 and evaporating a refrigerant in a liquid state to a gaseous state. The heat pump 9 further includes a refrigerant compressor 3 configured for compressing, and thereby heating, a gaseous refrigerant. A heat exchanger assembly 4 is adapted for delivering heat from the heated refrigerant to circulating water from a pool or a spa. The heat exchanger assembly 4 includes an inlet 5 for taking in unheated water and an outlet 6 for delivering heated water after it passes through the heat exchanger assembly 4. A pair of electrical insulation fittings 8 is provided at the heat exchanger assembly 4 to insulate the heat exchanger assembly 4 from transferring an electrical charge to the water circulating through the heat exchanger assembly 4. The inlet 5 and the outlet 6 are connected to a pump and filter circuit (not shown) that circulates water through the heat exchanger assembly 4. A metering device 7, such as an expansion valve, is provided between the evaporator 2 and the heat exchanger assembly 4. The metering device 7 creates a high pressure on one end thereof, for condensing the hot compressed refrigerant gas, and a low pressure on the other end thereof, to evaporate the cooled liquid refrigerant. The compressor 3 includes a motor to compress the refrigerant gas against the metering device 7 and circulate it through the evaporator 2 and the heat exchanger assembly 4. The refrigerant is circulated through refrigerant tubing, typically made from a titanium alloy, stainless steel, or copper, that runs between the evaporator 2, the compressor 3, and the heat exchanger assembly 4. As will be explained in greater detail hereinafter, the heat exchanger assembly 4 has a coiled structure having an inner coil and an outer coil disposed substantially concentrically about the inner coil. The inner and outer coils of the heat exchanger assembly 4 maximize the surface area of the tubing that is in contact with the water to promote heat transfer.

Figure 2:
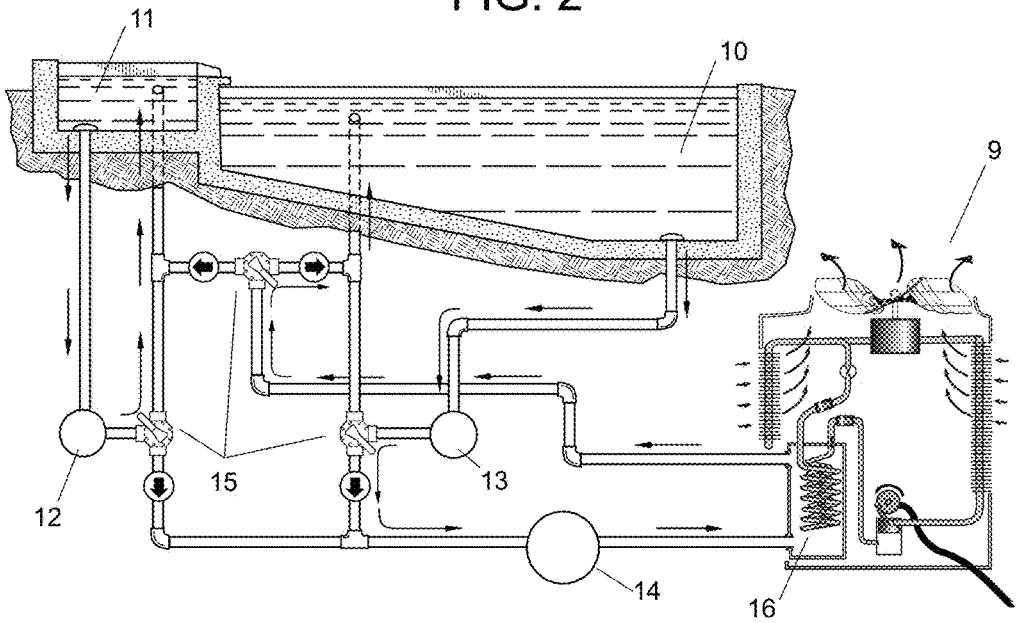
FIGS. 2-3 show various swimming pool/spa plumbing configurations in use with the heat pump shown in FIG. 1.
Figure 3:
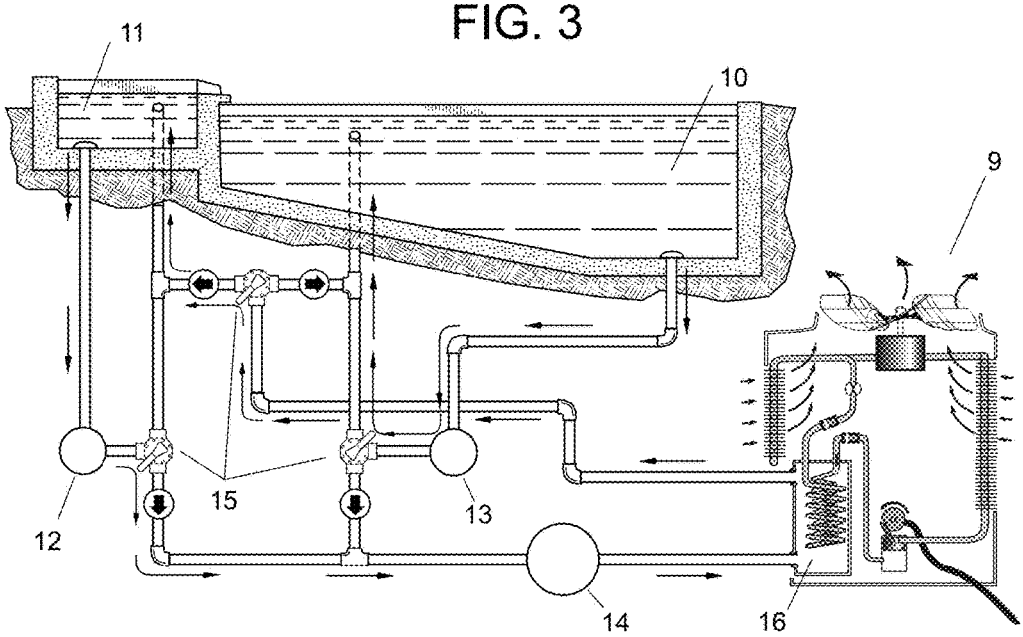
Figure 4:
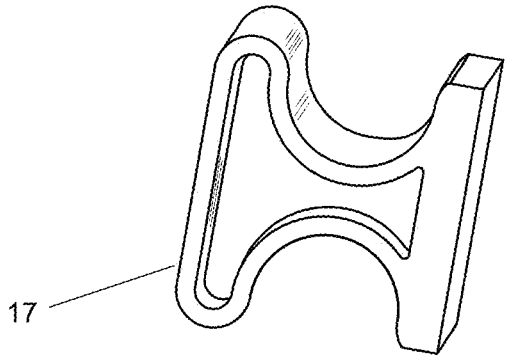
FIG. 4 is a perspective view of a coil key in accordance with a prior art embodiment.
Figure 5:
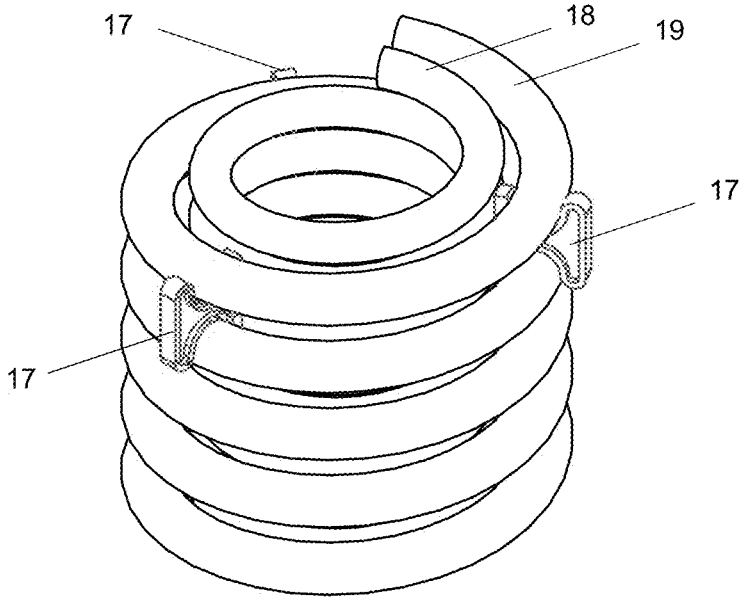
PRIOR ART FIG. 5
FIG. 5 is a perspective view of the prior art coil key shown in FIG. 1 in use with a heat exchanger coil assembly.

With reference to FIGS. 2-3, various swimming pool/spa plumbing configurations are shown for use with the heat pump 9. Depending on the arrangement of the two-way valves 15, water from a pool 10 and/or a spa 11 is circulated through the heat pump 9 by a spa pump 12 and/or a pool pump 13. Heated water can be diverted to flow into the pool 10 (FIG. 2) or into the spa 11 (FIG. 3). Prior to entering the heat exchanger housing 16, water is filtered through a filter 14. In operation, there are a plurality of sources that create vibration and rubbing of the coils of the heat exchanger assembly 4. The constant switching of water flow through the heat exchanger housing 16 creates hydraulic shocks that act on the coils of the heat exchanger assembly 4. At the same time, as the compressor 3 turns "off" and "on", the cycling of internal refrigeration pressure within the heat exchanger assembly 4 causes expansion and contraction of the coils. Therefore, it is desirable to prevent the vibration and rubbing of the coils of the heat exchanger assembly 9.

Figure 6:
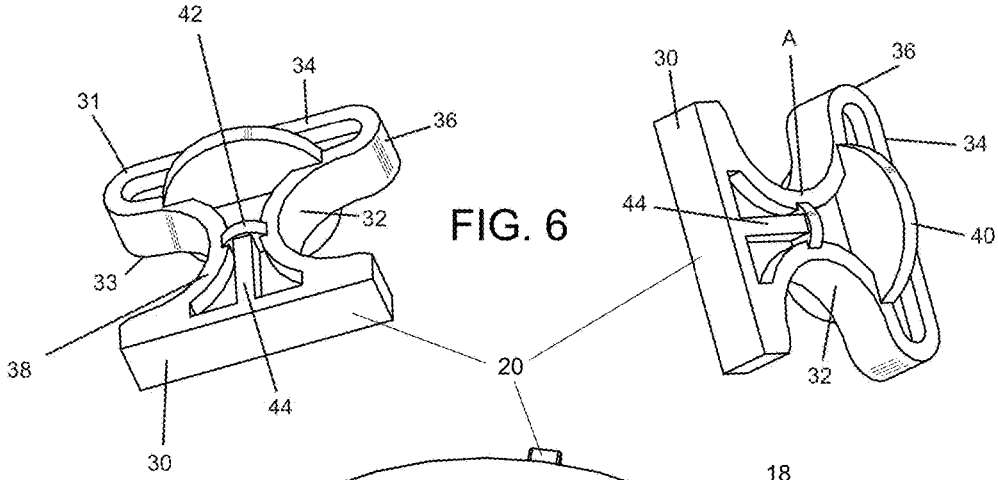
FIG. 6 is a perspective view of a coil key in accordance with a first embodiment of the present invention.

With reference to FIG. 6, a coil key separator device 20 (hereinafter referred to as "the separator device 20") is shown in accordance with a first preferred and non-limiting embodiment. The separator device 20 has an inner portion 30, a curved middle portion 32, and an outer portion 34. The outer portion 34 has rounded outer edges 36 to facilitate gripping and twisting the separator device 20 during installation between the coils of the heat exchanger assembly 4 (shown in FIG. 7), as will be described hereinafter. The inner portion 30 of the separator device 20 is substantially flat so that it may rest against the side of an inner coil of the heat exchanger assembly 4, as will be described hereinafter. Alternatively, the inner portion 30 may be curved or have rounded edges. The curved middle portion 32 connects the inner portion 30 to the outer portion 34. The curved middle portion 32 includes a pair of arcuately-shaped legs 38 that transition from the rounded outer edges 36 of the outer portion 34 to the outer edges of the inner portion 30. In this embodiment, the legs 38 are symmetrically arranged about a plane extending through a longitudinal midpoint of the separator device 20 extending between the inner portion 30 and the outer portion 34. The legs 38 desirably have a curvature that corresponds to the shape of the coils of the heat exchanger assembly 4.

With continuing reference to FIG. 6, the separator device 20 has a substantially flattened profile configured for insertion between adjacent coils of the heat exchanger assembly 4. The flattened profile is desirably thinner than a gap between adjacent coils prior to insertion of the separator device 20. The flattened profile defines a top surface 31 and a bottom surface 33 which are substantially planar. The top and bottom surfaces 31, 33 are separated by a sidewall that defines the thickness of the separator device 20. The outer portion 34 of the separator device 20 has a disc 40 formed as a projection that extends outward in a perpendicular direction from planes defining top and bottom surfaces 31, 33 of the separator device 20. The disc 40 may have a substantially circular shape that extends between the rounded outer edges 36 and at a transition between the rounded outer edges 36 and the legs 38. The disc 40 is shaped such that it is larger than the gap between adjacent coil portions of the outer coil 19 (shown in FIG. 7). In this manner, the disc 40 defines a stop surface that prevents over-insertion of the separator device 20 into the gap between the adjacent coil portions of the outer coil 19. Furthermore, the disc 40 diverts water flow impeding upon it toward the outer coil 19, thereby causing turbulence and enhancing heat transfer between the water and the heat exchanger assembly 4.

In one preferred and non-limiting embodiment, the separator device 20 further includes an arcuate lug 42 extending between the legs 38. The lug 42 may be provided at an approximate midpoint of the legs 38 at the apex A of the concave shape of each leg 38. The lug 42 may be formed as a projection that extends outward in a perpendicular direction from planes defining top and bottom surfaces 31, 33 of the separator device 20. At least one, and preferably a pair of ramps 44 connects the lug 42 to the inner portion 30 of the separator device 20. The ramps 44 may be co-planar to the planes of the top and bottom surfaces 31, 33 of the separator device 20.

In another preferred and non-limiting embodiment, the ramps 44 may be inclined relative to the planes of the top and bottom surfaces 31, 33, such that the ramps 44 extend from a low point defined on the inner portion 30 to a high point on the lug 42. The lug 42 is dimensioned to substantially correspond to a desired gap between adjacent coils of the outer coil 19 once the separator device 20 is inserted. In an embodiment where the ramps 44 are inclined, adjacent coils of the outer coil 19 are spread gradually to increase the gap therebetween up to a maximum gap defined by the size of the lug 42. Once the separator device 20 is inserted between the coils, such that the lug 42 is positioned between the approximate midpoints of the coils, the separator device 20 may be turned by 90 degrees in a clockwise or a counter-clockwise direction, such that the legs 38 are rotated to receive the coils within their arcuately-shaped form. By providing the lug 42 that spreads the coils to their final desired gap prior to the twisting of the separator device 20, less torsional input is required to twist the separator device 20 into its installed position. Once rotated, the inner portion 30 has a substantially planar face having sufficient length to extend from a top of first coil portions 18*a*, 19*a* to a bottom of second coil portions 18*b*, 19*b* located below the first coil portions 18*a*, 19*a* (FIG. 9).

Figure 7:
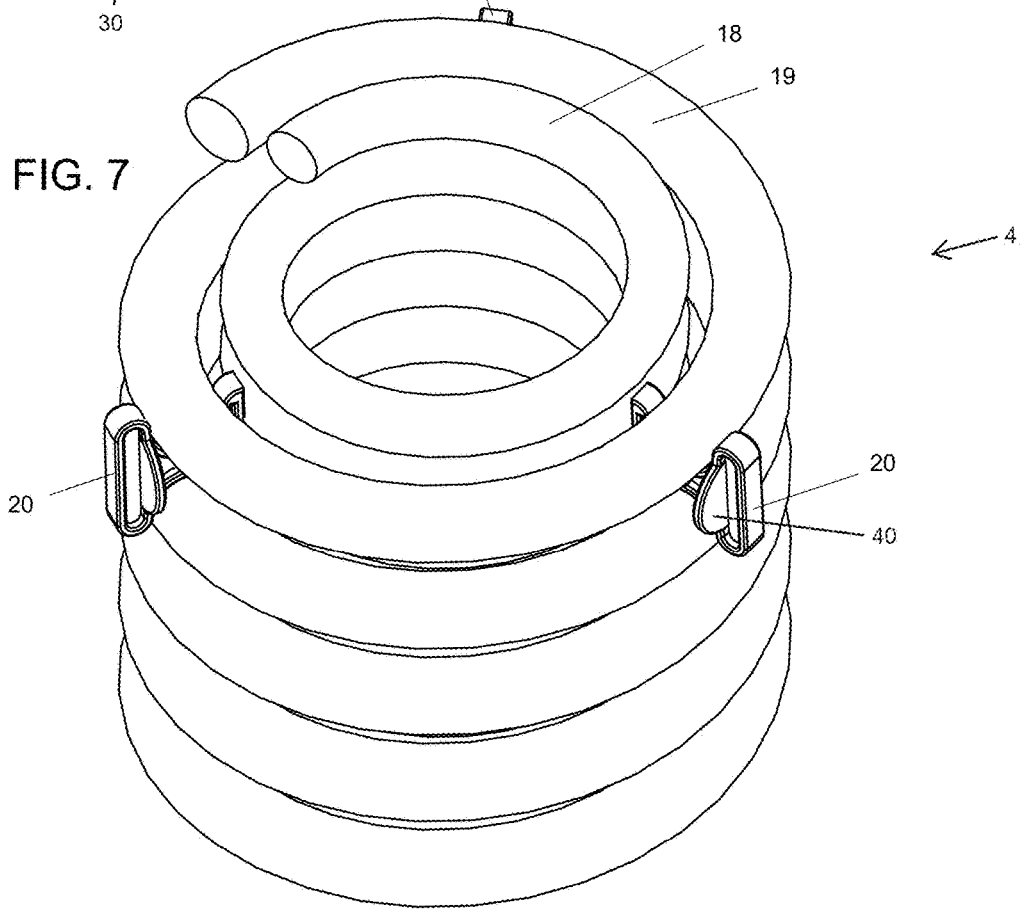
FIG. 7 is a perspective view of the coil key shown in FIG. 6 in use with a heat exchanger coil assembly.

With reference to FIG. 7, the heat exchanger assembly 4 has an inner coil 18 substantially concentrically arranged within an outer coil 19 along a central axis extending through heat exchanger assembly 4 along its longitudinal length. The inner and outer coils 18, 19 have a plurality of coil portions (18*a*-18*b*, 19*a*-19*b* shown in FIG. 9) that are helically wound from a first, upper portion of the heat exchanger assembly 4 to a second, lower portion of the heat exchanger assembly 4. Each coil portion is substantially tubular in structure. The inner coil 18 is separated from the outer coil 19 by a first space S1. The heat exchanger assembly 4 is disposed within a housing 21 (shown in FIGS. 8-9). The housing 21 may have a tubular shape such that the heat exchanger assembly 4 is disposed axially within the housing 21. A second space S2 is defined between the outer coil 19 and the inner wall of the housing 21 (shown in FIG. 8).

Figure 8:
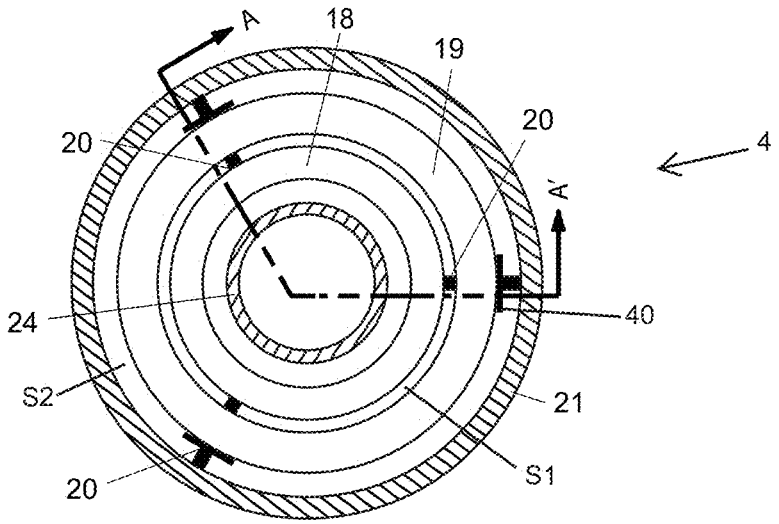
FIG. 8 is a top view of the coil key shown in FIG. 6 in use with the heat exchanger coil assembly.
Figure 9:
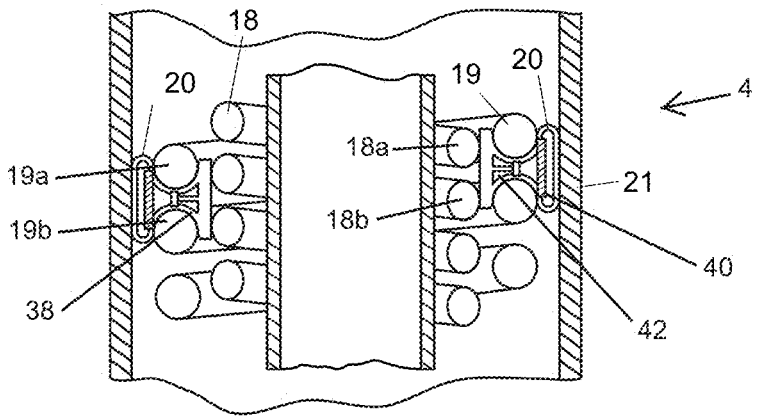
FIG. 9 is a cross-sectional view taken along line A-A' in FIG. 8.

With reference to FIGS. 7-9, a plurality of separator devices 20 are assembled between inner and outer coils 18, 19. In particular, as shown in FIGS. 7 and 8, three separator devices 20 are placed radially 120 degrees apart between adjacent coil portions of the outer coil 19. The spacing between the separator devices 20 dampens the vibration of the inner and outer coils 18, 19 and substantially prevents the coil portions of the inner and outer coils 18, 19 from vibrating against each other, and the outer coil 19 from vibrating against the housing 21. While FIGS. 7-8 illustrate three separator devices 20, in other preferred and non-limiting embodiments, more or fewer separator devices 20 may be used to separate the coils. Additionally, while FIGS. 7-8 illustrate three separator devices 20 at substantially equal radial separation, other preferred and non-limiting embodiments may have unequal radial separation between the separator devices 20. Furthermore, multiple sets of separator devices 20 may be utilized to separate the coils at different longitudinal levels of the heat exchanger assembly 4. For example, a first set of separator devices 20 may be used to separate the coils at an upper portion of the heat exchanger assembly 4, while one or more additional sets of separator devices 20 may be used to separate the coils at lower portions of the heat exchanger assembly 4 below the upper portion.

In various embodiments, the separator device 20 is sized to maintain an optimum gap between adjacent coils of the heat exchanger assembly 4 and the housing 21. Specifically, the separator device 20 is sized to maintain an optimum longitudinal gap between adjacent coil portions of the outer coil 19 and to maintain the radial spacing between the outer coil 19 and the housing 21. Furthermore, the separator device 20 is sized to maintain an optimum radial gap between the inner coil 18 and the outer coil 19. One of ordinary skill in the art will understand that various sizes and shapes of the separator device 20 are contemplated without being limited to a specific design of the heat exchanger assembly 4. For example, the separator device 20 may be used on a heat exchanger assembly 4 having an outer coil 19 without an inner coil 18.

The separator device 20 may be made from a rigid material, such as a plastic or a metal material that allows the separator device 20 to retain its shape and maintain the gap between adjacent coils of the heat exchanger assembly 4. In one preferred and non-limiting embodiment, the separator device 20 may be made from an injection-molded plastic material that is resistant to chemicals present in the pool or spa water and that minimizes friction between the separator device 20 and the coils of the heat exchanger assembly 4 during insertion of the separator device 20. Due to an increase in torsional strength compared to the prior art embodiments, the separator device 20 may be manufactured from low yield strength plastics, such as polypropylene and polyethylene.

Having described the structure of the separator device 20 in accordance with a first preferred and non-limiting embodiment, a method of installing the separator device 20 on a heat exchanger assembly 4 will now be described. As noted above, the separator device 20 is sized to maintain an optimum gap between adjacent coils of the heat exchanger assembly 4 and the housing 21. Prior to being inserted between the coils of the heat exchanger assembly 4, the separator device 20 is handled by gripping the outer portion 34. In some embodiments, the outer portion 34 may have an ergonomic shape to facilitate handling of the separator device 20. The outer portion 34 is desirably held such that the user's fingers grip the outer portion 34 at its top and bottom surfaces 31, 33 and between the rounded outer edges 36. After gripping the separator device 20, the separator device 20 is maneuvered between two coil portions (19*a*-19*b* in FIG. 9) of the outer coil 19 by inserting the inner portion 30 in a gap between the two coil portions. The separator device 20 is first inserted between the coil portions 19*a*, 19*b* in a first orientation, such that the inner portion 30 is substantially aligned in a horizontal direction of the gap. The separator device 20 is inserted in a radial direction from the exterior of the outer coil 19 toward its interior until the inner portion 30 contacts the inner coil 18 or until the disc 40 contacts the outer coil 19. During insertion of the separator device 20, the ramps 44 (shown in FIG. 6) spread the adjacent coil portions 19*a*, 19*b* to progressively increase the gap between the coil portions 19*a*, 19*b* up to a maximum desired gap in a final installation position. Upon coming into contact with the inner coil 18 (or being placed substantially proximate thereto), the separator device 20 is aligned with the outer coil 19 such that the lug 42 contacts the outer sidewall of the coil 19 at its approximate midpoint. The separator device 20 is then rotated until the coil 19 is disposed within the curvature of the legs 38. The same procedure may be repeated for any additional separator devices 20 installed radially or longitudinally apart from the installed separator device 20.

Figure 10:
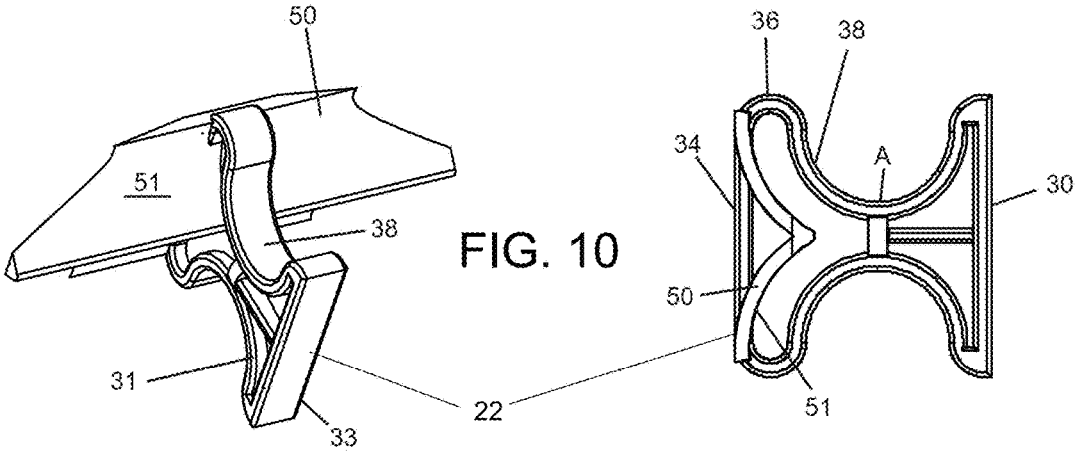
FIG. 10 is a perspective view of a coil key in accordance with a second embodiment of the present invention.
Figure 11:
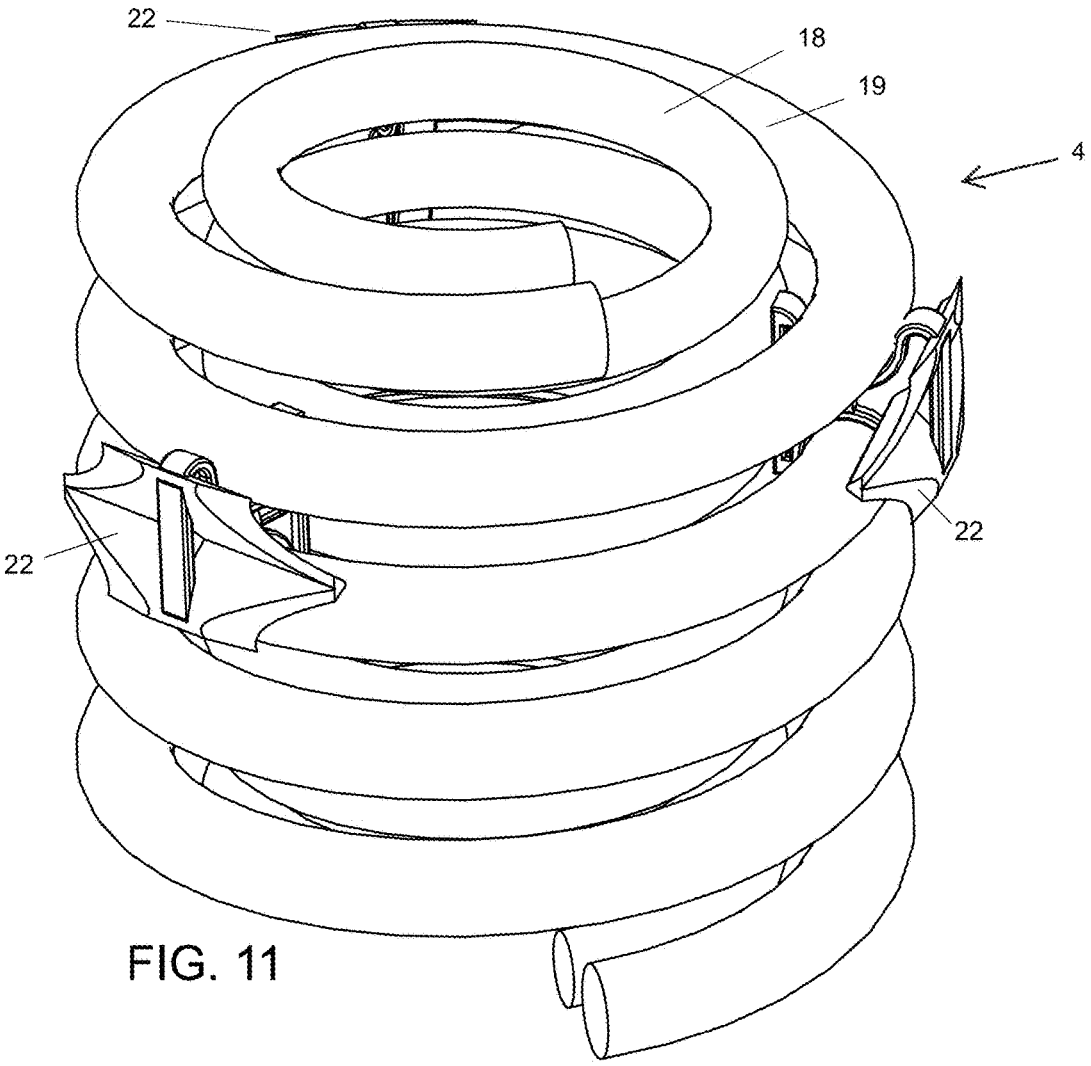
FIG. 11 is a perspective view of the coil key shown in FIG. 10 in use with a heat exchanger coil assembly.

With reference to FIG. 10, a separator device 22 is shown in accordance with a second preferred and non-limiting embodiment. The separator device 22 is similar to the separator device 20 described above and shown in FIGS. 6-9. Reference numerals in FIGS. 10-13 are used to illustrate identical components as the reference numerals in FIGS. 6-9. As the previous discussion regarding the separator device 20 generally shown in FIGS. 6-9 is applicable to the embodiment shown in FIGS. 10-13, only the relevant differences between these devices are discussed hereinafter.

While the separator device 20 in FIGS. 6-9 has a disc 40 provided on the outer portion 34, the separator device 22 has a wing 50. Similar to the disc 40, the wing 50 is formed as a projection that extends laterally outward in a perpendicular direction from the top and bottom surfaces 31, 33 of the outer portion 34. The wing 50 has two arcuate surfaces 51 that start from the rounded outer edges 36 and follow the curvature of the legs 38 to join at a point. The wing 50 is shaped such that it is offset from the legs 38 in order to define a space therebetween. The outer shape of the wing 50 is also shaped to correspond to the shape of the housing 21 (FIG. 12). Similar to the disc 40, the wing 50 defines a stop surface that prevents over-insertion of the separator device 22 into the gap between the adjacent coil portions of the outer coil 19. Furthermore, the wing 50 diverts water flow impeding upon it toward the outer coil 19, thereby causing turbulence and enhancing heat transfer between the water and the heat exchanger assembly 4. With reference to FIG. 13, water flow in the heat exchanger assembly 4 is typically in a bottom-to-top direction. The flow is predominantly directed through the center of the inner coil 18 and around the sides of the outer coil 19. FIG. 13 further illustrates a tube 24 extending through a central portion of the housing 21 over which the heat exchanger assembly 4 is positioned. Typically, there is little mixing or cross flow between the individual coils due to the inherent inertia of the fluid. With the wing 50 provided on the separator device 22, the shape of the wing 50 deflects the water flowing around the outer coil 19 to flow between the coils in the direction of the arrow 23. Such flow enhances the heat transfer by increasing the velocity of fluid flow between the coils, as well as creates turbulence in the flow along the sides of the housing 21 and the outer coil 19.

With reference to FIGS. 14-17, the separator device 20 is shown in use with an attachment 25. FIGS. 14 and 16 show the separator device 20 prior to being connected to the attachment 25, while FIGS. 15 and 17 illustrate the separator device 20 connected to the attachment 25. While FIGS. 14-17 illustrate the attachment 25 in use with the separator device 20 having a circular disc 40 shown in the first preferred and non-limiting embodiment of the present invention, in other embodiments, the attachment 25 may be configured for use with the separator device 22 having the wing 50 shown in FIGS. 10-13.

With reference to FIG. 14, the attachment 25 has a central receptacle 26 configured for receiving the disc 40 of the separator device 20. The central receptacle 26 has an opening 27 configured for receiving the outer portion 34 of the separator device 20 when the disc 40 is inserted into the central receptacle 26. The sidewall of the central receptacle 26 has a recess 28 shaped to receive the outer ends of the outer portion 34 to facilitate removal of the separator device 20 from the attachment 25. With continuing reference to FIG. 14, the opening 27 has at least one, and preferably a pair of locking tabs 29 configured for engaging the outer portion 34 and retaining the separator device 20 connected to the attachment 25. The locking tabs 29 are deflectable, such that they are pushed outward as the outer portion 34 enters the opening 27 and then snap over the outer portion 34, thereby capturing it and preventing rotational or translational movement relative to the attachment 25. Desirably, the attachment 25 is connected to the separator device 20 after the separator device 20 is installed on the heat exchanger assembly 4 (shown in FIG. 18) in a manner described hereinabove. In another preferred and non-limiting embodiment, the attachment 25 is connected to the separator device 20 prior to installing the separator device 20 on the heat exchanger assembly 4.

Figure 20:
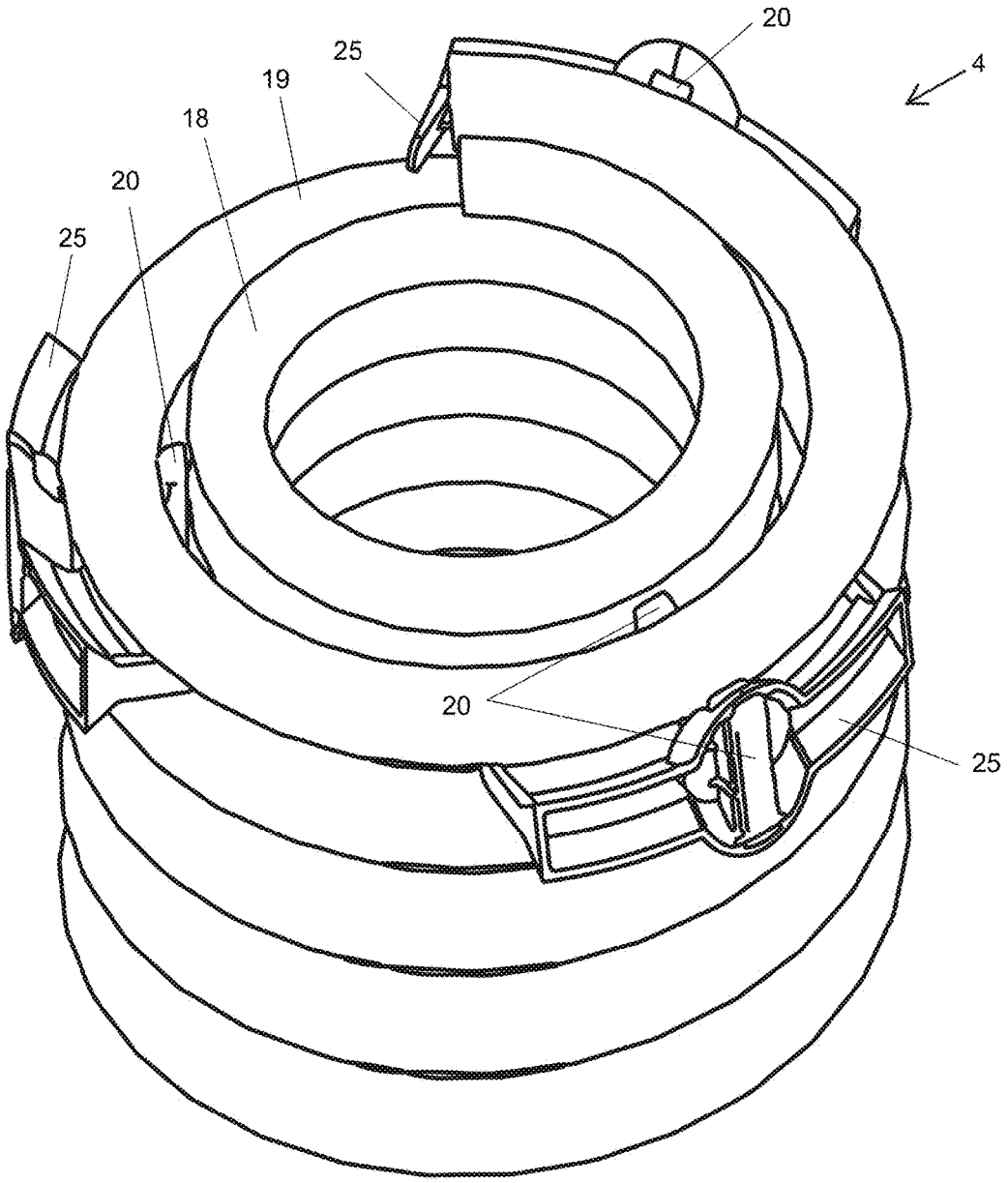
FIG. 20 is a perspective view of the coil key shown in FIG. 14 in use with a heat exchanger coil assembly.

With continuing reference to FIG. 14, the attachment 25 has at least one, and preferably a pair of extensions 52 extending radially outward from the central receptacle 26. The extensions 52 are desirably spaced about 180 degrees apart from each other. In one preferred and non-limiting embodiment, the extensions 52 are curved to correspond to the outside curvature of the outer coil 19 (shown in FIG. 18). Similar to the wing 50, each of the extensions 52 defines two arcuate surfaces that correspond to the rounded shape of the coil 19. The extensions 52 are offset from the coil portions 19*a*, 19*b* such that there is a space therebetween. In one embodiment, the extensions 52 extend around approximately $1/6^{th}$ of the outer circumference of the outer coil 19. Similar to the first preferred embodiment, a plurality of attachments 25 may be assembled between the inner and outer coils 18, 19 (FIG. 20). In particular, three attachments 25 are placed radially 120 degrees apart between adjacent coil portions of the outer coil 19. The spacing between the attachments 25 dampens the vibration of the inner and outer coils 18, 19 and substantially prevents the coil portions of the inner and outer coils 18, 19 from vibrating against each other, and the outer coil 19 from vibrating against the housing 21. While FIG. 20 illustrates three attachments 25, in other preferred and non-limiting embodiments, more or fewer attachments 25 may be used to separate the coils. Additionally, while FIG. 20 illustrates three attachments 25 at substantially equal radial separation, other preferred and non-limiting embodiments may have unequal radial separation between the attachments 25. Furthermore, multiple sets of attachments 25 may be utilized to separate the coils at different longitudinal levels of the heat exchanger assembly 4, such as, for example, every 4-5 coils.

Referring back to FIG. 14, the attachment 25 includes at least one, and preferably a pair of end plates 35 extending from the terminal ends of the extensions 52. The end plates 35 project from the extensions 52 in a plane substantially parallel to the coil centerline. In this manner, the end plates 35 orient the extensions 52 to be in a substantially parallel orientation relative to the gap between the coils. Furthermore, the end plates 35 prevent the attachment 25 from rotating when installed on the coil. The end plates 35 direct the fluid deflected from the curved surfaces of the extensions to enter the gap between adjacent coils. In one preferred and non-limiting embodiment, the end plates 35 fit tightly between the coils to define the same gap width as the separator device 20, thereby further improving vibration resistance of the heat exchanger assembly 4. The heat exchanger assembly 4 equipped with the separator device 20 and the attachment 25 has been found to be about 6-12% more efficient in transferring the heat from the coils to the water compared to known separator devices.

Figure 18:
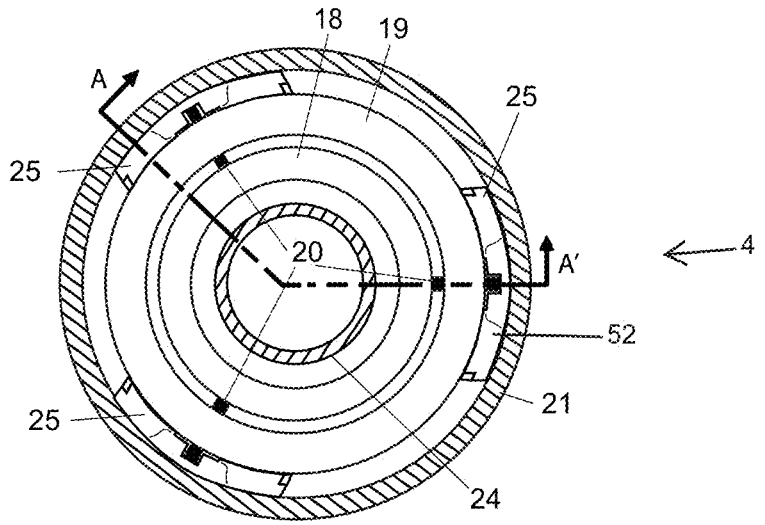
FIG. 18 is a top view of the coil key and the attachment shown in FIG. 14 in use with the heat exchanger coil assembly.
Figure 19:
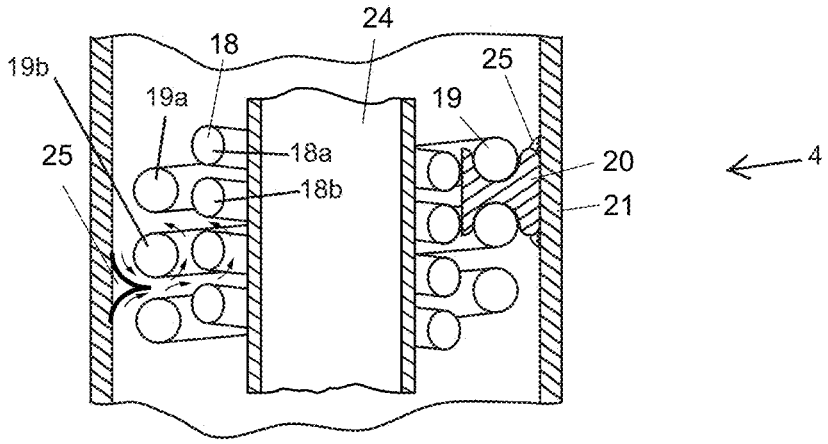
FIG. 19 is a cross-sectional view taken along line A-A' in FIG. 18.

Water flow in the heat exchanger assembly 4 is typically in a bottom-to-top direction. The flow is predominantly directed through the center of the inner coil 18 and around the sides of the outer coil 19. FIGS. 18 and 19 further illustrates a tube 24 extending through a central portion of the housing 21 over which the heat exchanger assembly 4 is positioned. Typically, there is little mixing or cross flow between the individual coils due to the inherent inertia of the fluid. The attachment 25 enhances fluid mixing by diverting fluid flow toward the center of the heat exchanger assembly 4, as shown in FIG. 19.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

What is claimed is:

1. A separator device for separating adjacent coils of a heat exchanger assembly, the separator device comprising:
- an inner end;
- an outer end;
- a curved middle portion between the inner end and the outer end, the curved middle portion having a pair of concave legs arranged symmetrically about a plane extending in a longitudinal direction of the separator device, each of the concave legs having a first end connected to the inner end, a second end connected to the outer end, and an apex between the first end and the second end;
- a top surface defined by an upper portion of the inner end, the outer end, and the curved middle portion;
- a bottom surface positioned opposite the top surface and defined by a lower portion of the inner end, the outer end, and the curved middle portion;
- an arcuate lug positioned between the concave legs and projecting away from top surface and the bottom surface; and
- a ramp on at least one of the top surface and the bottom surface, the ramp extending from the inner end to the arcuate lug.

2. The separator device of claim 1, wherein the ramp is inclined relative to the top surface and the bottom surface from the inner end to the arcuate lug.

3. The separator device of claim 1, wherein the arcuate lug is positioned between the apexes of the concave legs.

4. The separator device of claim 1, further comprising a disc extending from the top surface and the bottom surface at the outer end.

5. The separator device of claim 4, wherein the disc is substantially circular.

6. The separator device of claim 4, wherein the disc is larger than a gap between the adjacent coils of the heat exchanger assembly to prevent over insertion of the separator device into the gap.

7. The separator device of claim 1, further comprising an attachment having a central receptacle for receiving at least a portion of the separator device and a pair of extensions extending in opposite directions from the central receptacle.

8. The separator device of claim 7, wherein the central receptacle comprises at least one deflectable locking tab for connecting to the outer end of the separator device to the central receptacle.

9. The separator device of claim 7, wherein each of the extensions is curved to correspond to an outside curvature of the heat exchanger assembly.

10. A separator device for separating adjacent coils of a heat exchanger assembly, the separator device comprising:
- an inner end;
- an outer end;
- a curved middle portion between the inner end and the outer end, the curved middle portion having a pair of concave legs arranged symmetrically about a plane extending in a longitudinal direction of the separator device, each of the concave legs having a first end connected to the inner end, a second end connected to the outer end, and an apex between the first end and the second end;
- a top surface defined by an upper portion of the inner end, the outer end, and the curved middle portion;

a bottom surface positioned opposite the top surface and defined by a lower portion of the inner end, the outer end, and the curved middle portion;

an arcuate lug positioned between the concave legs and projecting away from top surface and the bottom surface;

a ramp on at least one of the top surface and the bottom surface, the ramp extending from the inner end to the arcuate lug;

a disc extending from the top surface and the bottom surface at the outer end; and an attachment having a central receptacle for receiving at least one of the outer end and the disc, and a pair of extensions extending in opposite directions from the central receptacle.

11. The separator device of claim 10, wherein the ramp is inclined relative to the top surface and the bottom surface from the inner end to the arcuate lug.

12. The separator device of claim 10, wherein the arcuate lug is positioned between the apexes of the concave legs.

13. The separator device of claim 10, wherein the disc is substantially circular.

14. The separator device of claim 10, wherein the disc is larger than a gap between the adjacent coils of the heat exchanger assembly to prevent over insertion of the separator device into the gap.

15. The separator device of claim 10, wherein the central receptacle comprises at least one deflectable locking tab for connecting to at least one of the outer end and the disc.

16. The separator device of claim 7, wherein each of the extensions is curved to correspond to an outside curvature of the heat exchanger assembly.

17. A heat exchanger assembly comprising:

an outer coil having a plurality of outer coil portions helically wound from a first outer coil end to a second outer coil end along a central axis; and at least one separator device positioned between adjacent outer coil portions, the at least one separator device comprising:

an inner end;

an outer end;

a curved middle portion between the inner end and the outer end, the curved middle portion having a pair of concave legs arranged symmetrically about a plane extending in a longitudinal direction of the separator device, each of the concave legs having a first end connected to the inner end, a second end connected to the outer end, and an apex between the first end and the second end;

a top surface defined by an upper portion of the inner end, the outer end, and the curved middle portion;

a bottom surface positioned opposite the top surface and defined by a lower portion of the inner end, the outer end, and the curved middle portion;

an arcuate lug positioned between the concave legs and projecting away from top surface and the bottom surface; and a ramp on at least one of the top surface and the bottom surface, the ramp extending from the inner end to the arcuate lug.

18. The heat exchanger assembly of claim 17, wherein the at least one separator device is configured to maintain a longitudinal gap between the adjacent outer coil portions.

19. The heat exchanger assembly of claim 17, further comprising an inner coil having a plurality of inner coil portions helically wound from a first inner coil end to a second inner coil end along the central axis, the inner coil concentrically positioned within the outer coil.

20. The heat exchanger assembly of claim 19, wherein the at least one separator device is configured to maintain a longitudinal gap between the adjacent outer coil portions and to maintain a radial gap between the inner coil and the outer coil.

* * * * *